US008863358B2

(12) United States Patent
Ochs

(10) Patent No.: US 8,863,358 B2
(45) Date of Patent: Oct. 21, 2014

(54) ADJUSTABLE HINGE

(71) Applicant: William J. Ochs, Parker, CO (US)

(72) Inventor: William J. Ochs, Parker, CO (US)

(73) Assignee: SZ Contracting, LLC, Parker, CO (US)

( * ) Notice: Subject to any disclaimer, the term of this patent is extended or adjusted under 35 U.S.C. 154(b) by 0 days.

(21) Appl. No.: 13/917,115

(22) Filed: Jun. 13, 2013

(65) Prior Publication Data

US 2013/0333160 A1 Dec. 19, 2013

Related U.S. Application Data

(60) Provisional application No. 61/659,815, filed on Jun. 14, 2012.

(51) Int. Cl.
*E05D 7/04* (2006.01)
*E05D 7/00* (2006.01)

(52) U.S. Cl.
CPC ..... *E05D 7/0009* (2013.01); *E05D 7/04* (2013.01)
USPC ..... 16/246; 16/238

(58) Field of Classification Search
CPC ..... E05D 7/0009; E05D 7/04; E05D 7/0407; E05D 7/0415; E05D 7/0423; E05D 2007/0009; E05D 2007/04; E05D 2007/0446; E05D 2007/0453; E05D 2007/0461
USPC ..... 16/235–238, 240, 242, 245, 246
See application file for complete search history.

(56) References Cited

U.S. PATENT DOCUMENTS

| | | | | | |
|---|---|---|---|---|---|
| 310,033 | A * | 12/1884 | Collamore | ..... | 16/246 |
| 880,317 | A * | 2/1908 | Von De Marwitz | ..... | 16/246 |
| 923,250 | A * | 6/1909 | Davis | ..... | 16/246 |
| 928,760 | A * | 7/1909 | Hunter | ..... | 16/238 |
| 1,019,184 | A * | 3/1912 | Peterson | ..... | 16/246 |
| 1,288,907 | A * | 12/1918 | Johnson | ..... | 16/246 |
| 1,381,072 | A * | 6/1921 | Kerstetter | ..... | 16/246 |
| 4,825,507 | A * | 5/1989 | Killingstad | ..... | 16/241 |
| 5,339,493 | A * | 8/1994 | MacIntyre | ..... | 16/238 |
| 5,694,665 | A * | 12/1997 | Strickland et al. | ..... | 16/238 |
| 5,701,636 | A * | 12/1997 | Jahnke | ..... | 16/238 |
| 5,713,105 | A * | 2/1998 | Toomey | ..... | 16/245 |
| 5,799,370 | A * | 9/1998 | Davidian et al. | ..... | 16/236 |
| 6,516,494 | B2 * | 2/2003 | Nakamoto et al. | ..... | 16/271 |
| 7,350,272 | B2 * | 4/2008 | Fries | ..... | 16/246 |
| 7,552,511 | B2 * | 6/2009 | Campbell et al. | ..... | 16/238 |
| 7,650,670 | B2 * | 1/2010 | Baer et al. | ..... | 16/236 |
| 7,676,887 | B2 * | 3/2010 | Chung | ..... | 16/236 |
| 8,516,658 | B2 * | 8/2013 | Bultschnieder | ..... | 16/246 |

(Continued)

*Primary Examiner* — William Miller
(74) *Attorney, Agent, or Firm* — Russell T. Manning; Marsh Fischmann & Breyfogle LLP

(57) ABSTRACT

A hinge for pivotally attaching a door to a door frame is disclosed. The hinge has a first hinge plate, a first lifting element and a second lifting element. The first lifting element extends through the first hinge plate at a location proximate to a free edge, and is adapted for selective movement from a retracted position to an extended position extending above a mounting face of the first hinge plate. The second lifting element extends through the first hinge plate at a location proximate to a pivot edge of the first hinge plate, and is adapted for selective movement from a retracted position to an extended position extending above the mounting face. The first lifting element and second lifting element are disposed on opposing sides of a vertical reference axis disposed between the free edge and the pivot edge of the first hinge plate. A method is also disclosed.

8 Claims, 9 Drawing Sheets

(56) References Cited

U.S. PATENT DOCUMENTS 8,549,706 B2 * 10/2013 Bultschnieder ..... 16/238
2006/0260096 A1 * 11/2006 Fries ..... 16/246
2008/0244866 A1 * 10/2008 Stanley ..... 16/238
2008/0307606 A1 * 12/2008 Karlsson ..... 16/243

* cited by examiner

ADJUSTABLE HINGE

CROSS REFERENCE TO RELATED APPLICATIONS

This application claims the benefit of U.S. Provisional Application No. 61/659,815, filed Jun. 14, 2012, entitled "Adjustable Hinge". The patent application identified above is incorporated in its entirety herein by reference.

BACKGROUND

Installing a passage door in a building often requires the installer to adjust the exact position of the door in the frame so that the hinge edge of the door can freely swing open without binding and the catch side of the door is precisely aligned with the corresponding catch when closed, so that the latch or lock properly engages with the corresponding hardware on that side of the door frame. Most residential passage doors are now sold "pre-hung" while commercial doors are purchased as a "package" together with a separate frame, etc. A carpenter "sets" this door frame into the wall structure onsite. Wall finishing (drywall, panels, etc.) is then applied around the frame. Finally, hardware and the door are installed in the frame. That is, the door and door frame are purchased or shipped as a unit. The door frame, preferably with the door in place, is installed in the rough opening. The door frame and the door are thus created as a matched set. Despite this, the process of fastening the door frame in the rough opening can cause the door frame to distort slightly. Even such slight distortions can require that the door be adjusted slightly so that the latch and sealing functions of the door perform smoothly. A shim, which is a thin, relatively inexpensive, relatively incompressible piece of card stock usually, suffices to make such final adjustments. If there is too great of a gap on the strike portion of the installed door, the installation screws on the door-side of the hinge are usually unscrewed enough to permit one or more of the shim cards to be inserted between the hinge plate and the door. To move the hinge towards strike side of the door frame, one inserts the shim card stock between the back side of the hinge mortise and the back side of the hinge plate at a location near the hinge knuckles, and retightens the mounting screws. This moves the hinge knuckles towards the strike side of the frame. This is done to as many hinges as necessary to achieve desired reveal at the door edges. Moving the hinge knuckles towards the strike side of the frame hopefully closes the previously oversized gap on the strike side of the door.

Similarly, to provide a larger gap on the strike side on a mounted door, the hinge plates on the door frame are loosened by unscrewing the mounting screws and one or more pieces of shim card are placed along the free edge of the hinge plate. When the screws are tightened again, this positions the hinge knuckles further away from the strike side of the frame, and a slightly larger gap on the strike side hopefully results.

SUMMARY

Disclosed is a hinge for a passage door having a first hinge plate to be mounted on door frame/door jam and a second hinge plate to be mounted on the side of a door. Hinge knuckles on the hinge plates pivotally connect the two plates together. There are screw holes in at least one of the hinge plates for mounting the hinge to a door frame. This hinge plate has a pivot edge that has hinge knuckles, and it also has a free edge opposite the edge with the hinge knuckles. There is at least one lift element (e.g., jack screw) threaded through this hinge plate at a position close to the edge with the hinge knuckles and at least a lift element threaded through this hinge plate at a position close to the free edge of the hinge plate. In this way, one or both of these lift elements can be rotated and thus moved relative to the hinge plate to pivot the hinge plate about a vertical axis and thus move the hinge knuckles towards or away from the strike side of the door frame when the hinge is mounted on the opposite side of the door frame from the strike side. In this way, a door hinged to the door frame by the hinge can be adjusted.

Also, disclosed is a method for adjusting a passage door in a door frame. This method comprises providing a plurality of hinges attached to a hinge edge of the door. These hinges are used for hanging the passage door in the door frame for hinging motion between an open and a closed position. At least one of these hinges has a hinge plate with hinge knuckles mounted for hinging the door to the door frame. This hinge plate has holes for receiving screws for attaching the hinge plate to one of either of the door or the door frame, and has at least a pair of lift elements mounted in the hinge plate at locations spaced at least at two different lateral positions away from the hinge knuckles. These lift elements are sized to the positioned to adjustably bear against one of either the door edge or the door frame (whichever it is mounted on) when the door is mounted by the hinge and the mounting screws in the door frame. In this way, the hinge knuckles are moved towards or away from either the door that it mounts or the frame to which it is mounted.

DETAILED DESCRIPTION

Figure 1:
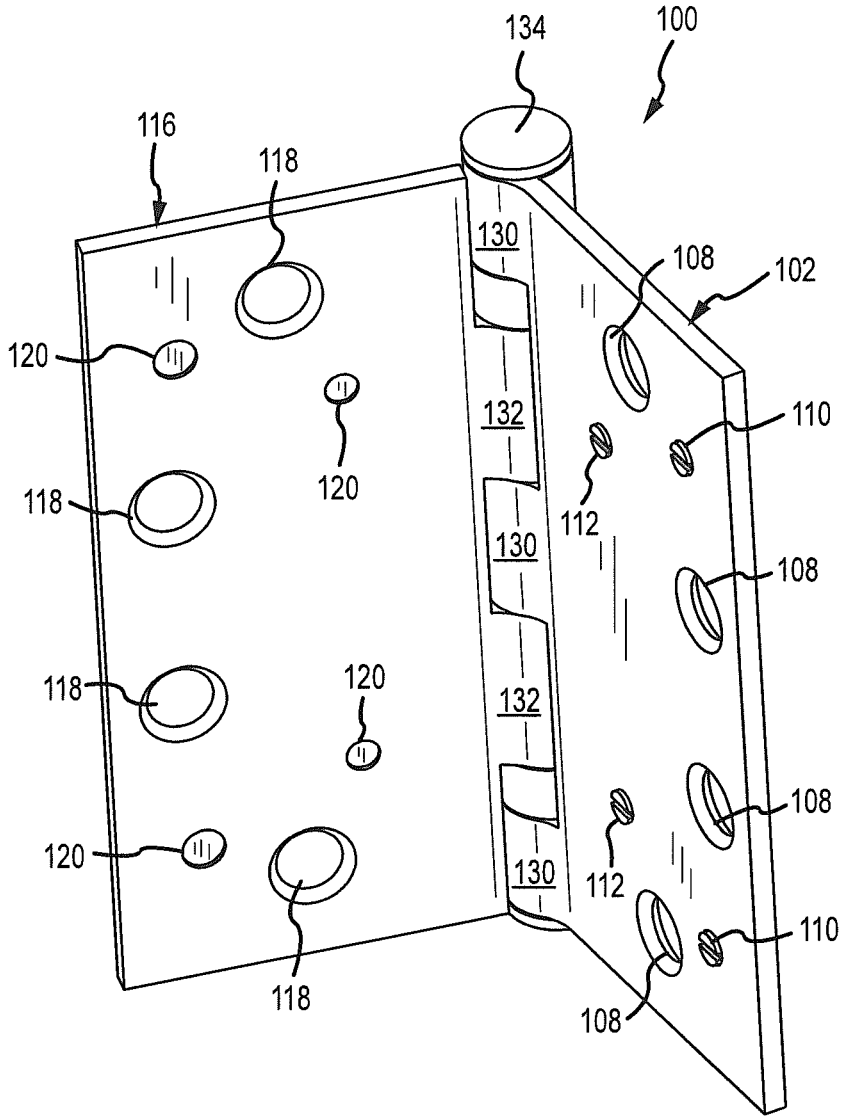
FIG. 1 is a perspective view of a hinge according to one embodiment of the invention.

Disclosed herein is a hinge assembly in accordance with various aspects of the presented invention. In one embodiment, the major components of the hinge assembly are substantially identical to a commercially available hinge, however, this is not a requirement. In this embodiment, the exemplary hinge assembly includes two hinge plates having a size equivalent to a commercial hinge; approximately 4.5×4.5 inches.

As shown in FIGS. 1-4, the hinge 100 has a first hinge plate 102 for mounting to a first mounting surface and a second hinge plate 116 for mounting to a second mounting surface. In the present embodiment, a first plurality knuckles 130 attached to the first hinge plate 102 are interlaced with a second plurality of knuckles 132 attached to the second hinge plate. A hinge pin 134 extends through the hollow interiors of the first and second sets of knuckles 130, 132 to pivotally attach the first and second hinge plates 102, 116. Typically, one of the first hinge plates 102 or 116 will be mounted to a door frame/jamb and the other hinge plate 102, 106 will be mounted to a door to allow pivotal movement of the door relative to the door frame.

Figure 2:
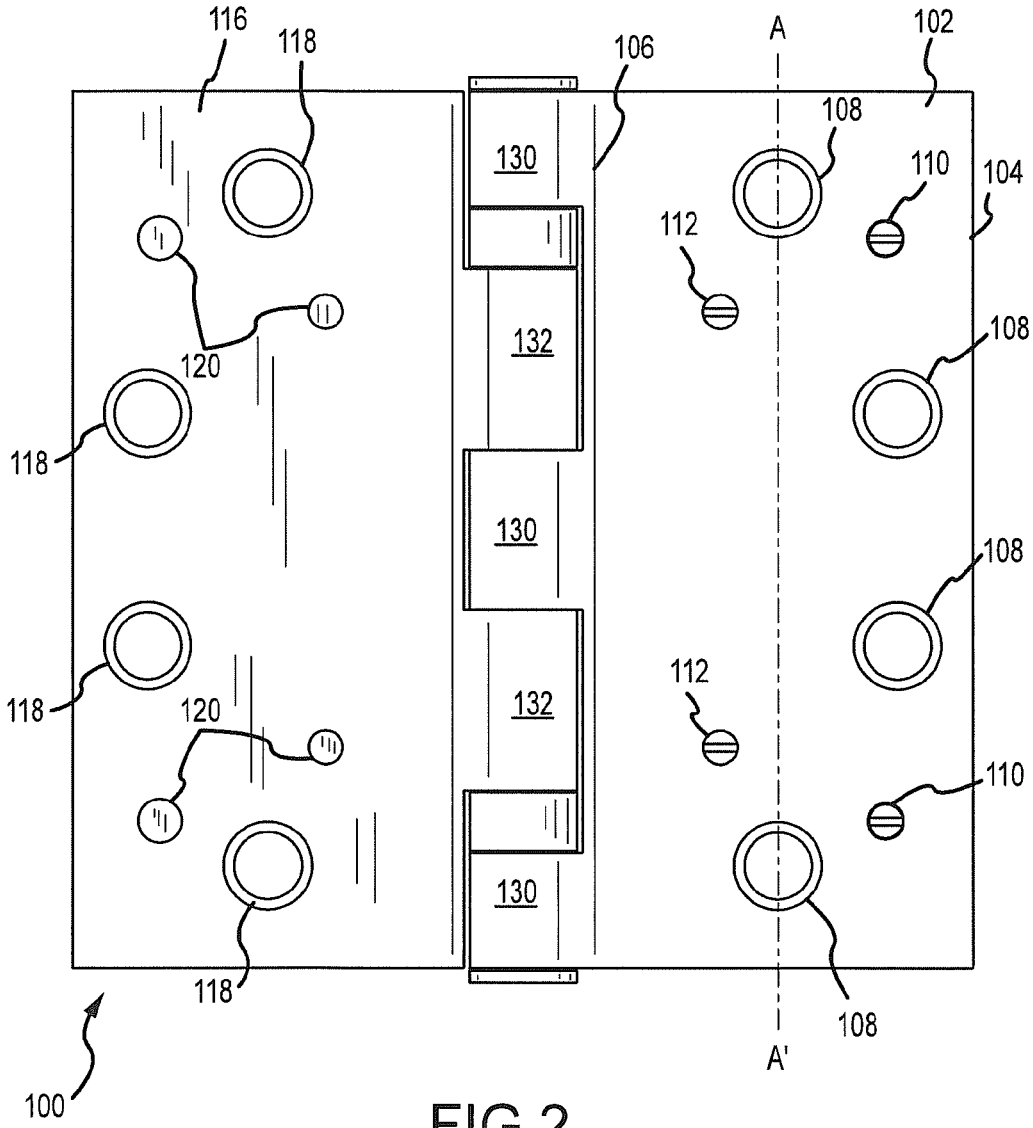
FIG. 2 is a front plan view of the hinge of FIG. 1.
Figure 3:
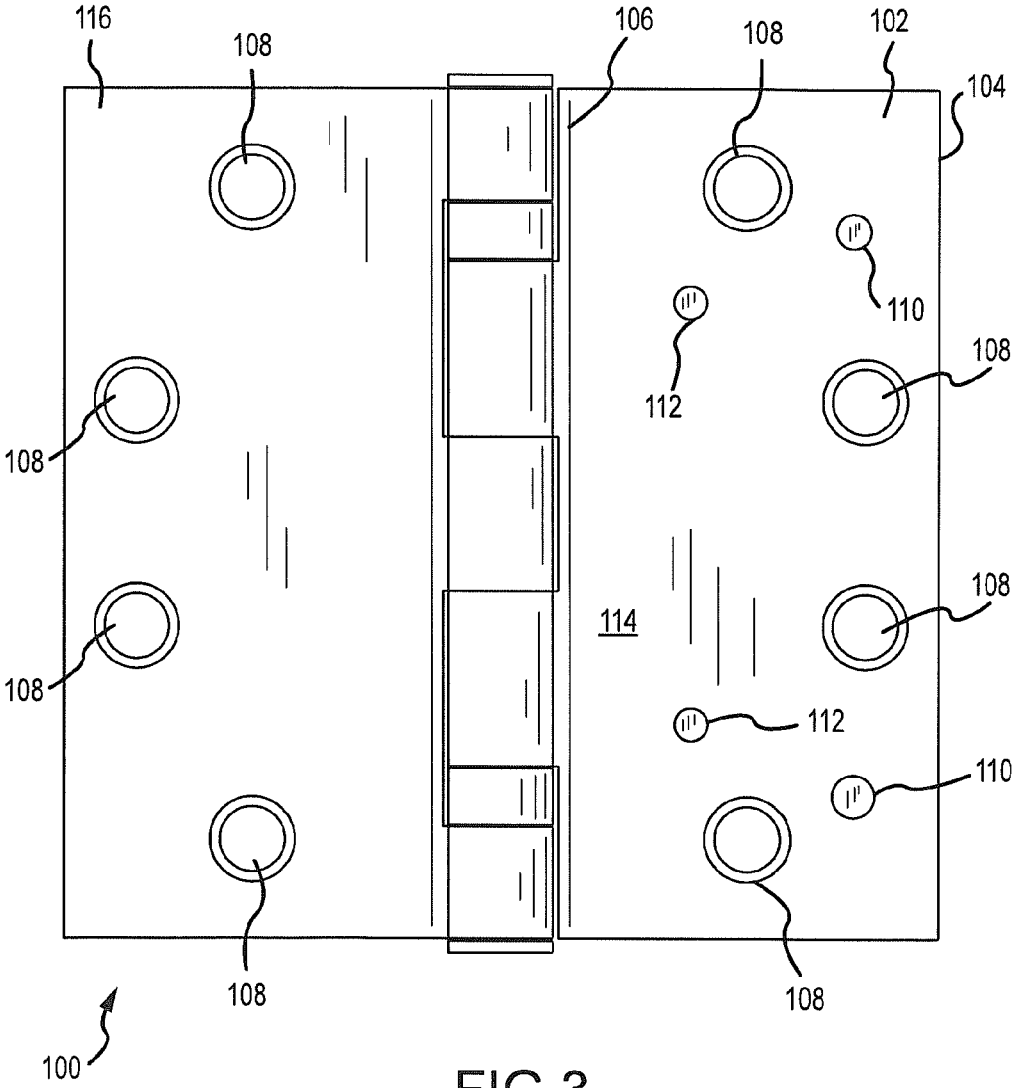
FIG. 3 is a back plan view of the hinge of FIG. 1.

The hinge plates 102, 116 each have a plurality of apertures 108, 118, respectively, to receive machine screws or wood screws for mounting the hinge plates to door frame or door. These apertures 108 are each countersunk on the front surfaces of the hinge plates 102, 116 as illustrated in FIGS. 1 and 2. Although four fastening apertures 108 are shown in each plate 102, 116, it should be understood that more or fewer fastening apertures 108 may be utilized, depending on the type of surface to which hinge plates are being attached, as well as space requirements/size of the hinge. Though illustrated as a hinge having first and second plates with a plurality of interlacing knuckles, it will be appreciated that aspects of the present invention may be incorporated into differently configured hinges that allow a door to rotate relative to a door frame. Likewise, the components of hinge 100 may be manufactured of any suitable material, but are usually made of steel, stainless steel, brass, or a combination thereof. Coating, hardening, or other surface treatments may be provided. As long as strength requirements are met, any suitable material may be chosen.

As shown, the first hinge plate 102 has a free edge 104 and a pivot edge 106 that define a body therebetween through which the fastener apertures 108 extend. The free edge 104 refers to the portion of first hinge plate 102 that is distal to the knuckles 130. Although shown as a straight edge in the figures, it should be understood that free edge 104 may be any shape desired. For example, where stronger materials are used in the manufacture of first hinge plate 102, less material may be necessary, and free edge 104 may be curved in a manner to minimize material use. In some cases, free edge may be shaped in a decorative manner. The pivot edge 106 refers to a portion of first hinge plate 102 that is proximate to the knuckles 130. Pivot edge 106 may be integrally formed with the hinge knuckles 132 as shown. However, any suitable component for enabling rotation of a second hinge plate to the first hinge plate may be utilized. The first hinge plate 102 further includes at least a first lifting element 110 and at least a second lifting element 112. These lifting elements 110, 112 are disposed at different horizontal locations (i.e., relative to a vertical axis defined by the knuckles 130/hinge pin 134) across the width of the first hinge plate 102. That is, the first lifting element 110 is disposed more proximal to free edge 104 of the first plate 102 than the second lifting element 112 and the second lifting element 112 is disposed more proximal to the pivot edge 106 than the first lifting element 110. In one embodiment, the first and second lifting elements 110, 112 are disposed on opposing sides of a vertical reference axis A-A' that is substantially centered between the free edge 104 and pivot edge 106 of the first plate 102. See FIG. 2.

Figure 5:
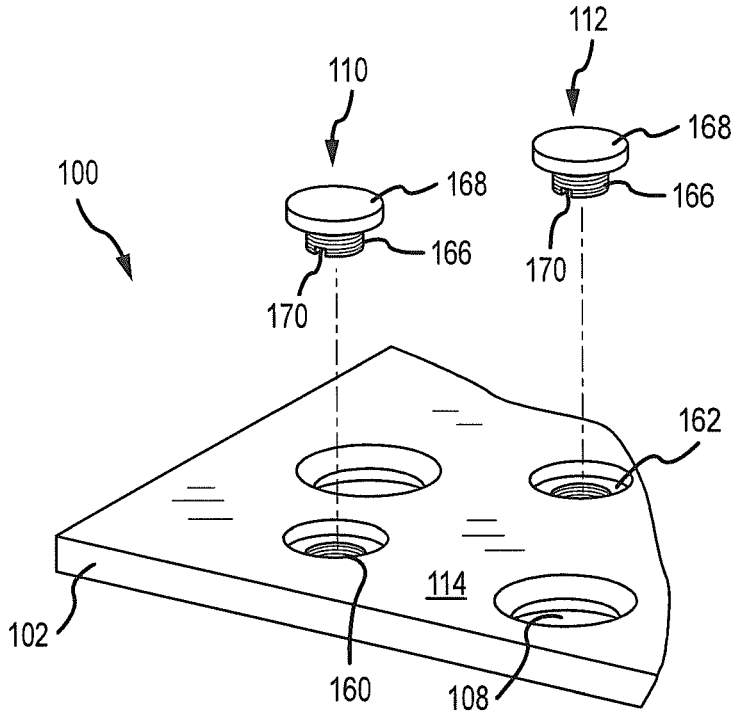
FIG. 5 is a partial back perspective view of the hinge of FIG. 1 illustrating the lift elements of the hinge.

Referring to FIG. 5, a partial view of the back side of hinge plate 102 illustrates the first lifting element 110 and the second lifting element 112. As shown, the first and second lifting elements 110, 112 are formed as threaded elements, which are adapted for threaded receipt within first and second threaded apertures 160, 162, respectively. In one emebidment, the lift elements 110, 112 are jack screws that consist of a ten by twenty-four (10×24) threaded shaft 166 which engage correspondingly threaded apertures that extend through the thickness of the hinge plate 102. The threaded shaft 166 terminates at an enlarged foot 168 which defines a contact end of the lift elements and provide a surface adequate to bear against, but not penetrate, the bottom or flat portion of a mounting surface, for example, a hinge mortise on the door frame. If the door frame is metal with a reinforcing plate, this foot may be smaller or omitted entirely.

In this embodiment, engagement of the threaded lift elements 110, 112 with a corresponding threaded apertures 160, 162 enables each lift element to be extended and retracted relative to the back surface or mounting face 114 of the hinge plate 102. To permit the foot 168 of the lift elements to be retracted to a flush position against the back mounting surface 114 of the hinge plate 102 (See, e.g., FIGS. 3 and 4), the threaded apertures 160, 162 may include a countersunk rim that is sized to receive the foot.

To adjust the position of either of the lift elements 110, or 112 relative to mounting face 114, a user may interface a drive element 170 on the free end or adjustment end of the threaded shaft 166. In this embodiment, the drive element 170 is a slot configured to allow a user to rotate the lifting element using a flathead screwdriver. Accordingly, the lifting element can be rotated/threaded between retracted and extended positions. It should be understood, of course, that the drive elements 170 are not limited to slots, and that the user tool is not limited to a screw driver. Any suitable interface can be used.

The length of the treaded shaft 166 of each of the lift elements may be longer than the thickness of the hinge plate 102. Accordingly, the adjustment end of these lift elements can extend above the front surface of the hinge plate 102. See FIGS. 1 and 2. To accommodate the potential extension of these lift elements above the front surface of the first hinge plate 102, the front surface of the second hinge plate 116 has several dimples or indentations 120 on its front surface. See FIGS. 1 and 2. These indentations 120 align with the adjustment end or shaft of the lift elements 110, 112 to assure that regardless of the position of the lift elements 110, 112, any protruding portions do not interfere with the closure of the hinge plates 102, 116 when the door is closed and the hinge plates are touching or almost touching one another. In general, the dimples that correspond to the lift elements that are closely adjacent to the knuckles are not likely necessary since most hinges are built so that when the door is closed, there is a substantial gap (about an ⅛ of an inch) between the hinge plates. Accordingly, these dimples may be omitted. However, there is less of a gap between the plates at their free edges and thus, depending on the amount of adjustment available with the lift elements, the outermost dimples may be desired.

Although a single lift element located proximate to the free edge 104 of the hinge plate 102 and a single lift element located proximate to the pivot edge 106 of the hinge plate 102 could be adequate for the intended purpose of the hinge, as described below, it is preferred at least two such lift elements be provided in each of these laterally spaced positions relative to the plate edges. That is, in some embodiments, the hinge 100 includes four lift elements or jack screws. When four lift elements are utilized, the lift elements are arranged in pairs where each pair of lift elements 110, 110 and 112, 112 is vertically aligned. Phrased another way, the lift elements are arranged in two vertically spaced pairs, each vertically spaced pair being arranged horizontally distant from one another. In any embodiment, disposition of the lift elements on opposing sides of the hinge plate 102, allows for changing the angle of the hinge plate 102 relative to a mounting surface, as is discussed below. The horizontal spacing between each and in this case each vertically aligned pair of lift elements should be about ⅞ of an inch for a typical 4.5×4.5 inch commercial hinge. Whatever horizontal spacing is chosen, it is should be adequate to provide a slight but substantial rotational positioning of the hinge plate 102 about the vertical reference axis relative to its normal position when one pair or the other of the lift elements bear against or engage a mounting surface such as the bottom of the hinge mortise in a door frame.

Figure 6A:
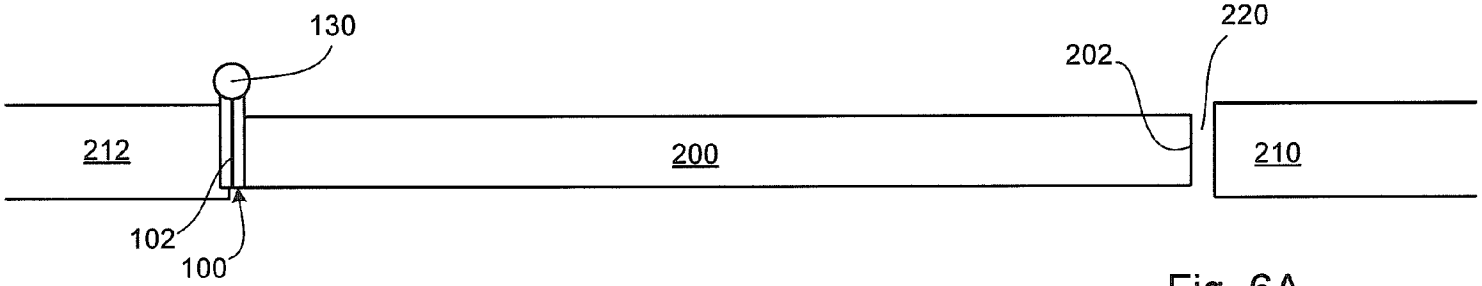
FIG. 6A is a schematic view of a hinge in a neutral position.
Figure 6B:
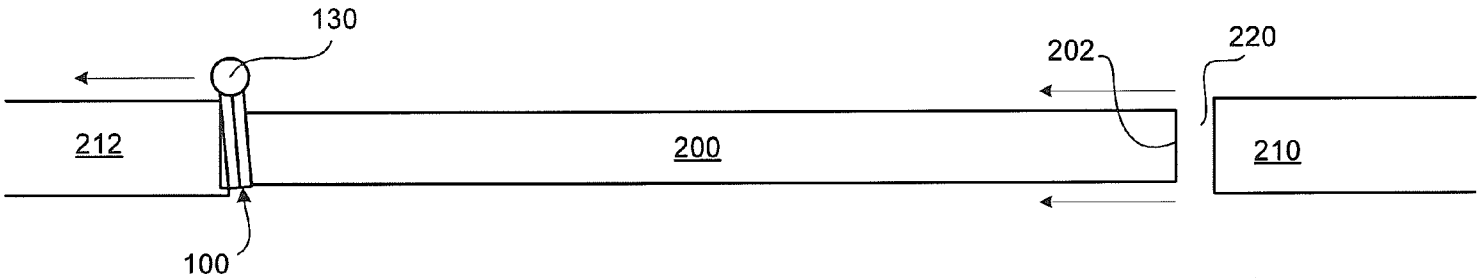
FIG. 6B is a schematic view of a hinge adjusting a door away from the strike side frame.
Figure 6C:
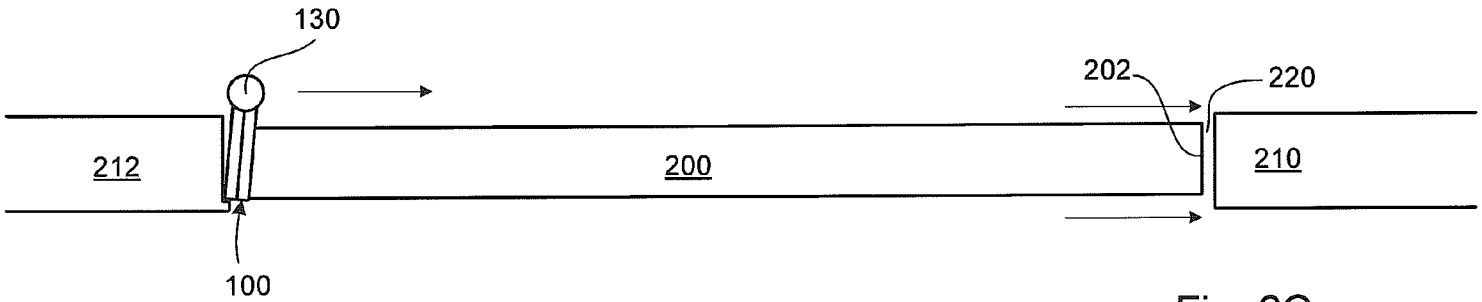
FIG. 6C is a schematic view of a hinge adjusting a door toward the strike side frame.

FIGS. 6A-6C briefly demonstrate how manipulation of the lift element(s) of the hinge 100 adjusts the angle of the hinge plate 102, the corresponding position of its knuckle 130, and the resulting relation of an attached door to an opposing strike side door frame/jamb 210. For purposes of this document, it shall be understood that the term "hinge side" refers to side of a door or frame to which hinges are mounted and "strike side" refers to the side of the door or frame opposite of the hinges. Generally, it can also be seen from FIGS. 6A-6C that adjusting the hinge 100 adjusts the gap 220 between the strike end 202 of the door 200 and the strike side of the frame 210. More specifically, the first and second lifting elements 110, 112 provided with the presented hinge 100 can be used to effect adjustment of a door as follows. To move the knuckle 130 of the hinge plate 102 relative to a hinge side 212 of a door frame, one of the lift elements 110, 112 can be adjusted outwardly or inwardly to in effect, rotate or pivot the hinge plate 102 about the vertical reference axis A-A' (See FIG. 2). In so doing, the hinge plate 102 will pivot the hinge knuckles 130 about that vertical reference axis A-A'. If a lift element close to the free edge of the hinge plate 102 is is turned to cause its protrusion against the hinge side 212 of the door frame structure, the hinge plate 102 pivots about a vertical axis such that the knuckle 130 is moved away from the strike side 210 of the door frame. This moves strike side 202 of the door away from the strike side of the door frame and increases the gap 200 between the door 200 and the strike side 210 of the door frame. See FIG. 6B. Alternatively, if a lift element adjacent the knuckles 130 is turned to cause its protrusion against the hinge side 212 of the door frame structure, the hinge plate pivots about a vertical axis such that the knuckles 130 of the hinge are moved toward the strike side 210 of the door frame. This moves the strike side 202 of the door toward the strike side of the door frame and decreases the gap 200 between the door 200 and the strike side 210 of the door frame. See FIG. 6C. In this way, the hinge can be used to both increase and decrease the gap between the door and the strike side of the door frame in a manner similar to but simpler than the use of the narrow strips of shim material normally inserted between the corresponding free and knuckle edges of the hinge plate and the door frame mortise.

Figure 7C:
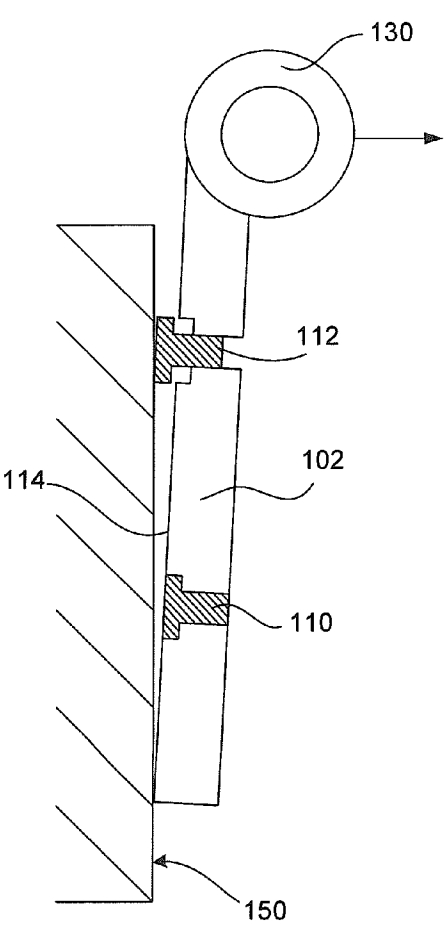
FIG. 7C is a schematic view of the lift elements adjusting a door toward the strike side frame.
Figure 7B:
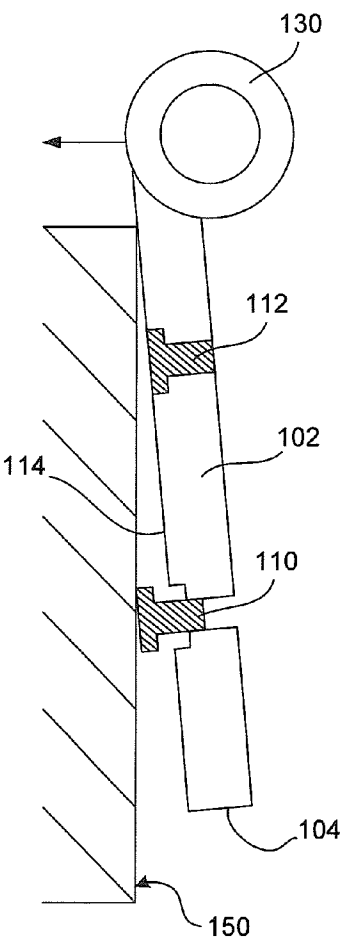
FIG. 7B is a schematic view of the lift elements adjusting a door away from the strike side frame.
Figure 7A:
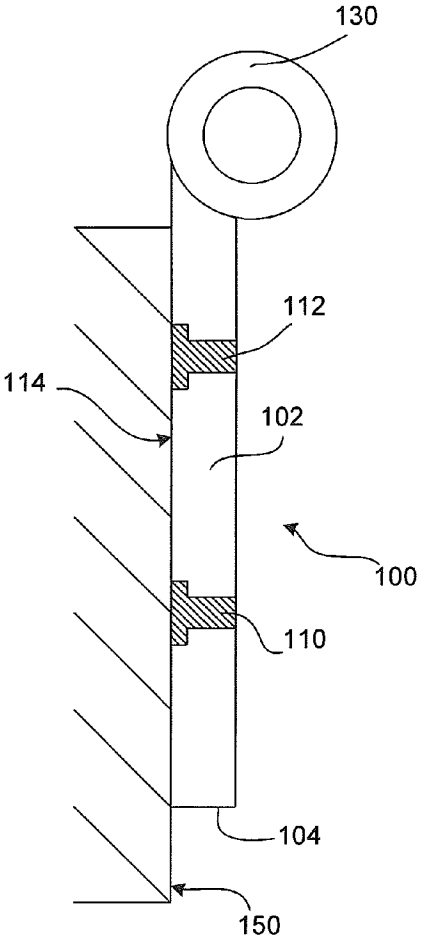
FIG. 7A is a schematic view of the lift elements of a hinge in a neutral position.

The functionality of the lifting elements 110, 112 are more clearly exemplified in FIGS. 7A-7C, which display offset sectional views of hinge 100 abutting door frame mounting surface 150, with the first lifting element 110 and the second lifting element 112 in various positions. First, in FIG. 7A, first lifting element 110 and second lifting element 112 are in a retracted position, flush with a mounting face 114 of first hinge plate 102. When both lifting elements are in this retracted position, the first mounting face 114 is flush with the door frame mounting surface 150 (e.g., mortise), and defines a neutral position of the hinge plate 102. In this neutral position, the mounting face 114 of the hinge plate 102 is juxtaposed against the door frame mounting surface 150. That is, these surfaces are parallel. It should be understood for purposes of this document that, when referencing first mounting face 114, the term "above" refers to a direction normal to first mounting face 114, that is, that direction intended for contact with the door or door frame mounting surface. It should also be noted here that, when referencing lifting elements, such as first lifting element 110 or second lifting element 112, the terms "contact end" and "adjustment end" may be used. When used in relation to lifting elements, "contact end" is that end of a lifting element intended to contact a mounting surface, such as a door or door frame. "adjustment end", in contrast, is that portion of a lift element at the opposing end relative to the contact end.

Where, as in FIG. 7B, where the first lifting element 110 is in an extended position above the mounting face 114 and the second lifting element 112 is in a retracted position, the knuckle 130 is rotated away from the strike side 210 of the door frame. See FIG. 6B. Positioning the first lifting element 110 and the second lifting element 112 as shown in FIG. 7B causes the strike side 202 of an attached door 202 to be positioned more distally to the strike side 210 of an opposing door jamb than it is in the neutral position shown in FIG. 7A.

Alternatively, as in FIG. 7C, the first lifting element 110 is in a retracted position and the second lifting element 112 is in an extended position above first mounting face 114 such that the knuckle 130 is rotated toward the strike side 210 of the door frame. See FIG. 6C. Positioning the first lifting element 110 and the second lifting element 112 as shown in FIG. 7C causes the strike side 202 of an attached door 202 to be positioned more proximal to the strike side 210 of an opposing door jamb than it is in the neutral position shown in FIG. 7A. In viewing FIGS. 7A-7C, it will be apparent that a retracted position may be below first mounting face 114, instead of flush with first mounting face 114 as shown. It will also be apparent that an extended position may be any suitable extended position above first mounting face 114 that would provide the desired displacement of a strike side of a door with a corresponding strike side of the door frame.

Figure 8:
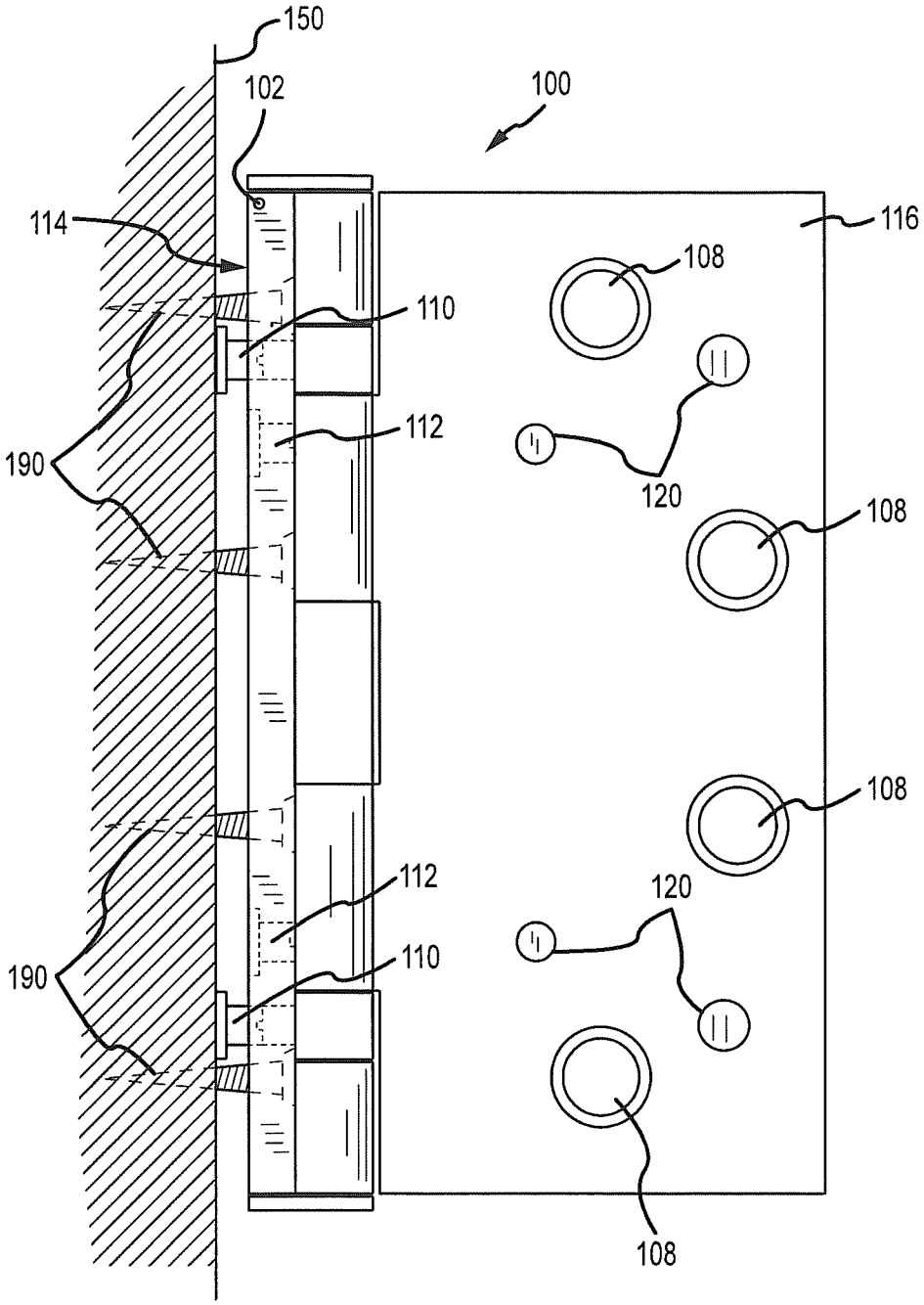
FIG. 8 is a sectional side view of a hinge according to an embodiment of the invention, attached to a mounting surface.

Referring now to FIG. 8, a side view of the hinge 100 is shown loosely attached to a mounting surface 150 using fasteners 190 extending through the fastening apertures in the first plate 102. In this embodiment, first lifting element 110 has a pair of lifting elements vertically spaced from one another, and second lifting element 112 has a pair of lifting elements vertically spaced from one another. In the position shown in FIG. 8, the top and bottom lifting elements of first lifting element 110 are extended above a mounting face 114 of the hinge plate 102 while the top and bottom lifting elements of the second lifting element 112 are retracted flush against the mounting face 114. Should the hinge 100 then be tightened against the mounting surface, a pivot edge of the hinge plate 102 would be pulled against the mounting surface, while a free edge of first mounting plate 102 would be maintained away from the mounting surface. See, e.g., FIGS. 6B and 7B.

Alternatively, the top one of each pair of lifting elements in each of first and second lift elements 110, 112 could be extended, while the bottom one of each pair of lifting elements in each of first and second lift elements 110, 112 could be retracted. In such a configuration, a top edge of the hinge plate would be maintained away from the mounting surface, while bottom edge of the hinge plae would be allowed to rest against the mounting surface. In contrast, the top one of each pair of lifting elements could be retracted, while the bottom one of each pair of lifting elements could be extended. In such a configuration, a top edge of the hinge plate would be maintained against the mounting surface, while bottom edge of the hinge plate would be maintained away from the mounting surface.

Figure 9:
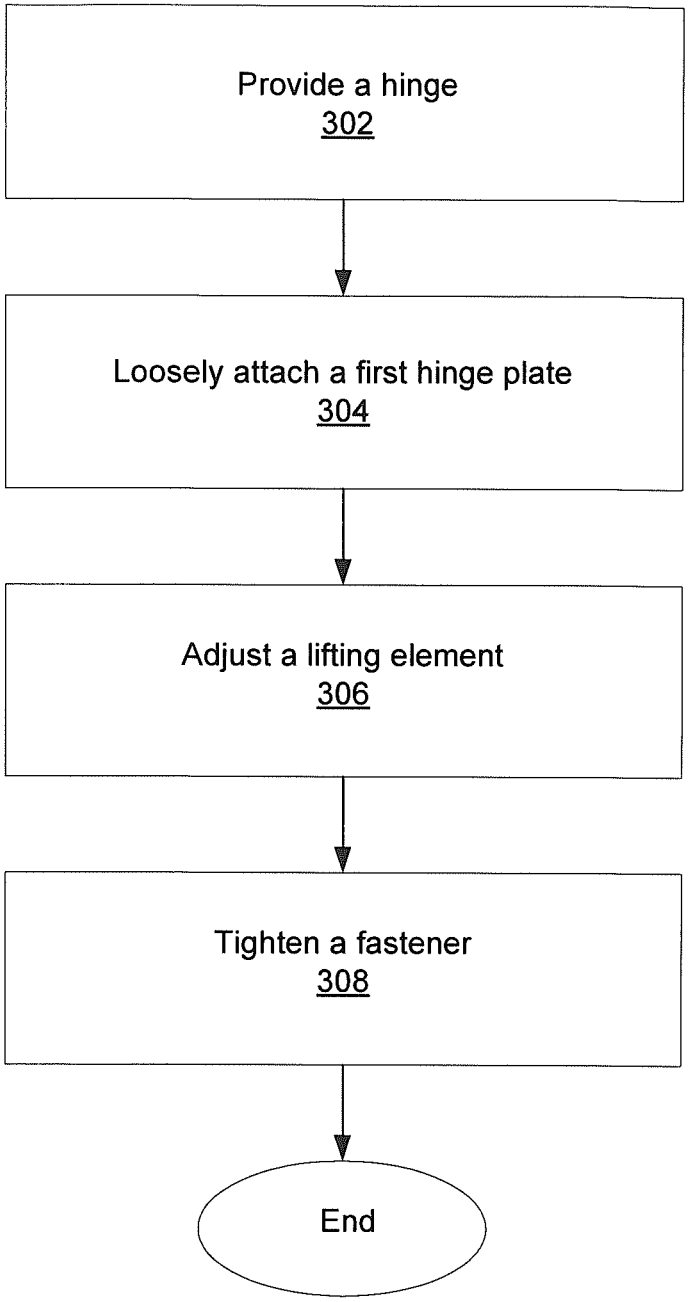
FIG. 9 illustrates a method of adjusting a hinge in accordance with the presented hinge.

Referring now to FIG. 9, a method 300 of mounting a door to a frame is disclosed. The method 300 includes the steps of providing a hinge 302, loosely attaching a first hinge plate 304 to a mounting surface, adjusting a lifting element 306, and tightening a fastener 308.

Providing a hinge 302 is performed by providing a hinge for pivotally attaching a door to a door frame where the hinge has a first hinge plate with a mounting face extending between a free edge and a pivot edge. The first hinge plate includes a plurality of fastener apertures for receiving fasteners for attaching the first hinge plate to a first mounting surface and at least a first lift element extending through the first hinge plate at a location proximate to the free edge, and at least a second lift element extending through the first hinge plate at a location proximate to the pivot edge. The first and second lifts elements are each adapted for selective movement from a retracted position substantially flush with the first mounting face to an extended position extending above the first mounting face. The first lifting element and the second lifting element are disposed on opposing sides of the hinge plate relatie to the free edge and the pivot edge of the first hinge plate.

Loosely attaching 304 the first hinge plate is performed by inserting fasteners through one or more apertures in the first hinge plate and part way into the first mounting surface. The term "loosely", as it applies to method 300, means attaching such that the first hinge plate is fixed to the first mounting surface, but the relative position of the first hinge plate can be adjusted slightly by pushing, pulling, or twisting of the first hinge plate without removing the fastener.

Adjusting 306 is performed by adjusting at least one of the first lift element and the second lift element to achieve a desired lift of the pivot edge or a desired lift of the free edge away from the first mounting surface. In some embodiments, adjusting a lift element is performed by applying a torquing force to a drive element in a lift element that has a threaded element, and possibly a mounting foot.

Tightening 308 the fastener is performed in substantially the same manner as loosely attaching 304 the first hinge plate; however, the first hinge plate is fixed to the first mounting surface such that the first hinge plate is not adjustable by applying normal forces expected in the course of using a door that is mounted to the door frame. This would normally mean tightening 308 the fastener, and may include deforming a contact end of one of the first lift element and second lift element.

In general, the disclosed hinge allows for adjusting the gap between the strike edge of a door and a strike jamb of a door frame hinge. More specifically, knuckles of the hinge can be moved relative to the hinge side door jam by adjusting lift elements or jack screws. When lift elements closest to the knuckles are adjusted, the lift elements near the free edge of the hinge plate are not screwed down to protrude into the mortis. This moves the knuckles toward the stike side of the door jam and reduces the gap between the the strike side of the door and the door jamb. On the other hand, if the hinge is to be moved away from the strike side of the door jam, the jack screws adjacent the free edge of the hinge plate are screwed to screw towards or protrude out of the hinge plate and bear against the mortise in the door jam. This has the effect of rotating the hinge plate to swing the knuckles away from the strike portion of the door jam giving more space at that side of the mounted door. Alternatively, if the spacing is correct around the door, neither pair of lift elements screws need be operated on any of the mounted hinges. Later, when the building settles, thus warping the door frame slightly, or the door itself warps, swells or shrinks, the lift elements are in place, ready to be used in pairs on one or all the hinges to make the necessary adjustments to compensate for such changes to the door frame and door over time. For such changes, the mounting screws would be loosened enough to permit the appropriate lift elements to be adjusted into the slight space between the loosened hinge plate and the frame mortise. The mounting screws and the lift elements are thus adjusted so that when the mounting screws are finally tightened the adjusted lift elements support the hinge plate to thus position the knuckles for proper operation of the door.

Although hinge 100 has largely been discussed as having an adjustable first hinge plate 102, in some embodiments, second hinge plate 116 may by similarly adjustable. That is, the second hinge plate 116 may have additional lifting elements substantially similar to lifting elements 110, 112 of the first plate 102. In such an embodiment, the lifting elements of the second hinge plate 116 may be configured and adjusted in much the same manner to permit further adjustment between the second hinge plate and a second mounting surface (e.g. hinge edge of a door).

Other alterations to the hinge are possible and considered within the scope of the present invention. For instance, although the first mounting surface, first lifting element 110, and second lifting element 112 are shown as being undeformed in the figures, any or all may be manufactured of materials that allow deformation. In particular, where a door is being mounted to a steel door frame, first lifting element 110 and second lifting element 112 may be manufactured of a softer material, to allow deformation when installed, so as to increase surface contact area. Alternatively, a wood door frame may allow a desired deformation to accommodate lifting elements made of relatively harder materials. In a further embodiment, the mounting foot may be made of a material that is different from the material used to form the threaded shaft. For example, a stronger, or less deformable, material may be desired for the threaded shaft while a more deformable material may be desired for the foot that may enable the foot to deform to better match an underlying mounting surface. Typically, however, the foot portion is affixed to the lift element and proivds a broad surface to bear against the surface of the door frame's mounting surface (e.g., hinge mortise).

Figure 4:
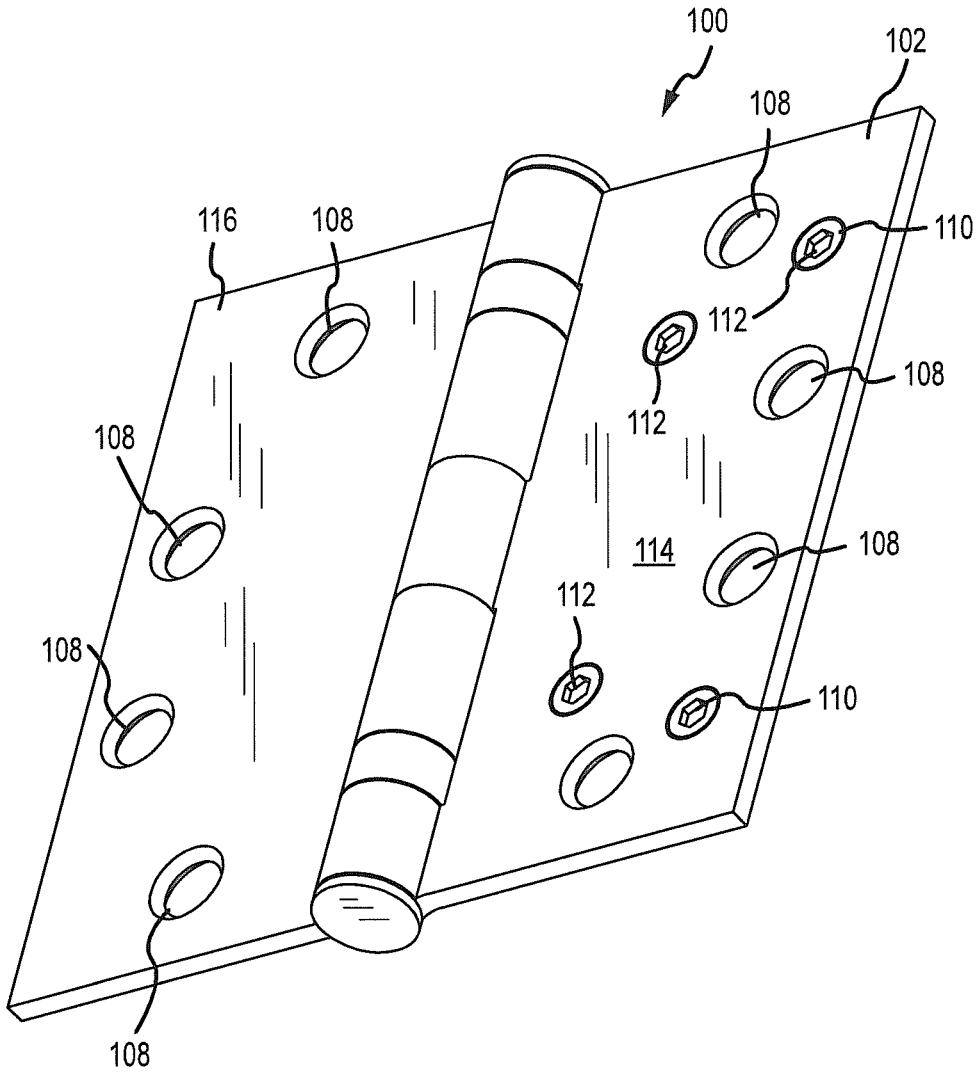
FIG. 4 is a back perspective view of the hinge of FIG. 1.

In addition, the configuration and/or location of the lift elements may be varied. For instance, the lift elements may have a Phillips screw interface at its adjustment end. Further, rather than have a ten by twenty-four (10×24) threaded portion with a ⅜ inch diameter foot protruding at one end, the jack screw could be a ⅜ inch diameter shaft with a flat end for bearing against the door jam. In this event, the foot portion may not have screw threads, especially when used on a wood rather than a steel or metal door frame. Threads leading too close to the surface of the foot could catch into the door frame material and bore into the backing plate or mortise's bottom surface and thus not provide the spacing desired for adjusting the door position in the frame. Also, as shown in FIG. 4, in some embodiments, the contact end of the lift elements may further include a second drive element 172 (e.g., hex key). One purpose of such a second drve element is to enable a manufacturer, supplier, or user to easily align and insert the lifting elements into the threaded apertures in the hinge plate 102. However this is not a requirement.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

The invention claimed is:

1. A hinge for pivotally attaching a door to a door frame, comprising:

first and second hinge plates pivotally connected, each of said first and second hinge plates including:

a mounting face extending between a free edge and a pivot edge, said hinge plate including a plurality of fastener apertures for receiving fasteners for attaching said hinge plate to a mounting surface;

a first lifting element extending through said hinge plate at a location proximate to said free edge, wherein said first lifting element is adapted for selective movement from a retracted position substantially flush with said mounting face to an extended position extending above said mounting face;

a second lifting element extending through said hinge plate at a location proximate to said pivot edge, wherein said second lifting element is adapted for selective movement between a retracted position substantially flush with said mounting face to an extended position extending above said mounting face;

wherein said first lifting element and said second lifting element are disposed on opposing sides of a vertical reference axis disposed between said free edge and said pivot edge of said hinge plate; and wherein disposing one of said first and second lifting elements in an extended position extending above said mounting face displaces one of said free edge and said pivot edge, respectively, away from the mounting surface when said hinge plate is attached to the mounting surface.

2. The hinge of claim 1, wherein:

said vertical axis is disposed substantially mid-way between said free edge and said pivot edge of said hinge plate.

3. The hinge of claim 1, wherein:

said first lifting element comprises a first threaded element for engagement with a first threaded aperture extending through said mounting face of said hinge plate; and said second lifting element comprises a second threaded element for engagement with a second threaded aperture extending through said mounting face of said hinge plate.

4. The hinge of claim 3, wherein:

said first threaded element further comprises a first mounting foot having a cross-dimension that is greater than a cross-dimension of a threaded portion of said first threaded element; and said second threaded element further comprises a second mounting foot having a cross-dimension that is greater than a cross-dimension a threaded portion of said second threaded element.

5. The hinge of claim 1, wherein:

said first lifting element comprises a mounting end, and a drive element at an opposing end, said drive element configured to enable a user to advance and retract said first lifting element between a retracted position and an extended position of said first lifting element; and said second lifting element comprises a mounting end, and a drive element at an opposing end, said drive element configured to enable a user to advance and retract said second lifting element between a retracted position and an extended position of said second lifting element.

6. The hinge of claim 1, wherein:

said first lifting element comprises a pair of lifting elements vertically spaced.

7. The hinge of claim 1, wherein:

said second lifting element comprises a pair of lifting elements vertically spaced.

8. The hinge of claim 1, wherein:

said second hinge plate includes a plurality of recesses in a front surface configured to allow said first lifting element and said second lifting element of said first hinge plate to nest within said second hinge plate when said first hinge plate and said second hinge plate are folded together.

* * * * *